United States Patent [19]

Lee

[11] 4,055,297

[45] Oct. 25, 1977

[54] FORCED AIR HEATING SYSTEM UTILIZING FIREPLACE AS PRIMARY HEAT SOURCE

[76] Inventor: Sherman E. Lee, Rte. 1, Box 69A, Newberg, Oreg. 97132

[21] Appl. No.: 733,315

[22] Filed: Oct. 18, 1976

[51] Int. Cl.[2] ..... F23N 0/00

[52] U.S. Cl. ..... 236/11; 237/51

[58] Field of Search ..... 236/11; 237/8 R, 51, 237/1 A; 126/121, 132, 133; 219/279

[56] References Cited

U.S. PATENT DOCUMENTS

| | | | |
|---|---|---|---|
| 551,651 | 12/1895 | Robinson | 126/132 |
| 2,186,539 | 1/1940 | Slayter et al. | 126/121 |
| 3,169,516 | 2/1965 | Agnese | 126/121 |
| 3,834,619 | 9/1974 | Glover | 237/81 |
| 3,958,755 | 5/1976 | Cleer | 237/1 A |
| 3,977,601 | 7/1976 | Bearzi | 126/271 |

*Primary Examiner*—William E. Wayner
*Assistant Examiner*—Robert Charuat
*Attorney, Agent, or Firm*—Chernoff & Vilhauer

[57] ABSTRACT

A forced air heating system for homes and other buildings wherein a fireplace with a circulating air heating chamber is interposed between the fan exhaust of a conventional forced air furnace and a network of air outlet registers positioned in the various rooms to be heated. A bypass air duct is positioned in parallel with the fireplace between the fan exhaust and the network of outlet registers to provide an alternate path for the forced air exhausted from the furnace fan. The system has a control circuit sensitive to room temperature, fireplace heating chamber temperature, and other duct temperatures for automatically operating the system either in a primary mode wherein the fireplace is the primary forced air heating source, or in a secondary mode where the furnace heating elements are the primary heat source. Automatically controlled dampers determine through which of the two parallel ducts the forced air from the furnace fan will travel to the outlet registers, dependent on the mode of operation. In the primary mode, the circuit automatically permits the furnace heating elements to act as a superheater for the heating air under conditions of low fireplace heat output, or alternatively to remain wholly unactivated under conditions of sufficient fireplace heat output.

13 Claims, 4 Drawing Figures

FORCED AIR HEATING SYSTEM UTILIZING FIREPLACE AS PRIMARY HEAT SOURCE

BACKGROUND OF THE INVENTION

This invention relates to improvements in forced air heating systems for homes and other types of buildings wherein the fireplace is utilized as a heat source for the forced air system. More particularly the invention is directed to such a system which includes a conventional forced air furnace operating in concert with a fireplace.

Forced air heating systems which utilize a combination of a fireplace and forced air furnace have been devised in the past, such as those shown in Slayter et al. U.S. Pat. No. 2,186,539 and Glover U.S. Pat. No. 3,834,619. However such systems do not capitalize fully on the energy-saving potential of which such systems should be capable because of several basic drawbacks in design. For example, the heating elements of the furnace portion of such prior systems are typically treated as the primary rather than secondary heat source, as evidenced by the fact that they are operated in response to the room thermostat in the conventional manner even though the fireplace may also be operating and producing substantial heat. This type of arrangement, which treats the fireplace merely as an auxiliary or secondary heat source even though in full operation, results in much more use of the furnace heating elements, and therefore much more use of electrical or other fuel energy, than is desirable in a system of this type whose objective should be to minimize the usage of such electrical power or other fuel energy.

Furthermore, such systems require that at least a portion of the heating air must always pass through the fireplace heat exchanger even though the fireplace may be totally inoperative. If the fireplace is located a substantially great distance from the furnace, which is often the case, this results in an unnecessarily lengthy duct path between the furnace and the individual room outlet registers in a system such as Slayter's where the fireplace is located on the exhaust side of the furnace. The long duct path in turn causes wasteful energy loss from the furnace-heated air when the fireplace is inoperative. Alternatively, in a system such as Glover's where the fireplace is located in the furnace inlet or cold air return duct, the heat generated by the fireplace when operative will be unnecessarily wasted by being required to travel to the furnace if the distance from the fireplace to the furnace is very lengthy, as may often be the case.

Accordingly what is needed is a system which is designed to utilize the fireplace as the primary heat source when operative and thereby require less utilization of the conventional heating elements than has previously been the case, and which does not require passage of the circulating heating air medium from the furnace through the fireplace heating chamber when the fireplace is inoperative, nor from the fireplace heating chamber through the furnace when the fireplace is operative.

SUMMARY OF THE PRESENT INVENTION

The present invention is directed to a forced air heating system for a building which satisfies the foregoing needs by providing a fireplace, having an air heating chamber for heating air circulated through the chamber, and a conventional forced air furnace, both connected to the air outlet room register system of the building for providing heated air thereto and interconnected with one another functionally and structurally in a novel manner which overcomes the foregoing disadvantages of prior systems. Functionally, the fireplace and the separate furnace heating elements are interconnected by a temperature responsive control circuit which permits the standard room thermostat to selectively activate or deactivate the furnace heating elements in response to room temperature only when the fireplace is not operating at a predetermined minimum heat-generating level, but which prevents the activation of the furnace heating elements by the room thermostat, independently of the room temperature, when the fireplace heat output exceeds the predetermined minimum level. Thus when the fireplace is operating at a sufficient predetermined heat-generating level, the fireplace is the primary heat source for the building heating system, and the furnace becomes merely a secondary source to be operated only if the fireplace heat output diminishes below a predetermined level. This has the important advantage of limiting the usage of the furnace heating elements to the bare minimum required, and therefore correspondingly limiting the use of energy from sources other than the fireplace, such as electricity, oil or natural gas needed to operate the furnace heating elements.

In the preferred embodiment of the system, when the fireplace is operating at a reduced but still sufficient level to justify its use as the primary heat source, the fireplace heating chamber is connected in series with the furnace exhaust, and the furnace heating elements are allowed to be activated, not in response to the room thermostat (which would make the furnace heating elements a primary heat source responsive to demand) but rather in response to the reduced temperature to which the fireplace heating chamber heats the circulating air, so as to superheat the air entering the fireplace heating chamber under the condition of reduced fireplace heat generation. In all cases wherein the fireplace is generating sufficient heat to be utilized as the primary heat source, the room thermostat controls the activation or deactivation of the motorized fan which circulates the heating air through the system, but is incapable by itself of causing actuation of the furnace heating elements.

To accomplish the additional major objective of permitting conduction of heating air from the furnace directly to the room outlet registers without intermediate passage through the fireplace heating chamber when the fireplace is inoperative, and of permitting conduction of heating air from the fireplace heating chamber directly to the room outlet registers without intermediate passage through the furnace when the fireplace is operating at above the aforementioned predetermined minimum level, both the furnace and fireplace heating chamber are connected to the room outlet registers by separate parallel ducts. Automatically controlled, motorized dampers are provided in the ducts for selectively permitting the passage of air through either one of the ducts while blocking the passage of air through the other. The position of these dampers is controlled by a temperature-responsive circuit which moves the dampers to impede air passage through the parallel duct connecting the furnace directly with the room outlet registers when the fireplace is operating at the predetermined minimum level or, alternatively, permit the passage of air directly from the furnace to the room outlet registers while impeding the passage of air through the parallel fireplace heating chamber duct when the fireplace level of operation is insufficient.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 1:
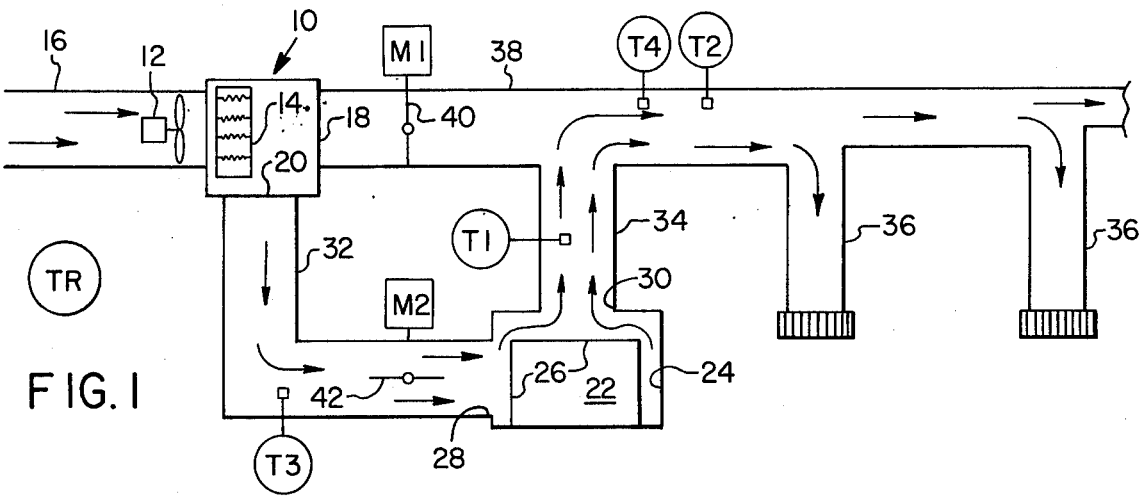
FIG. 1 is a simplified schematic drawing of an exemplary embodiment of the forced air heating system of the present invention, shown operating in a mode utilizing the fireplace as the primary heating source.
Figure 2:
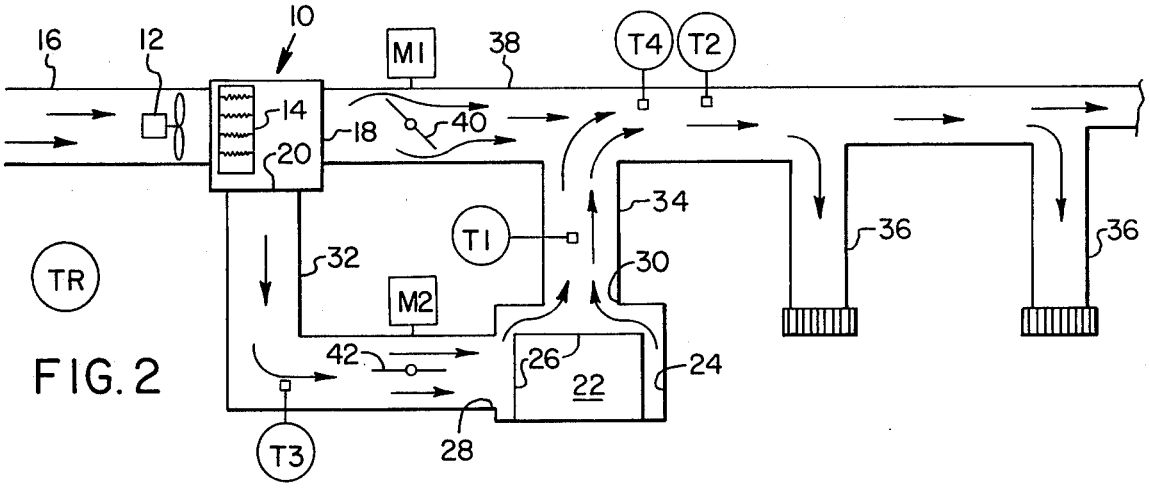
FIG. 2 is a schematic drawing of the system of FIG. 1, shown operating in the same mode but with ambient temperature air being mixed with the air heated by the fireplace so as to limit the temperature of the heated air.
Figure 3:
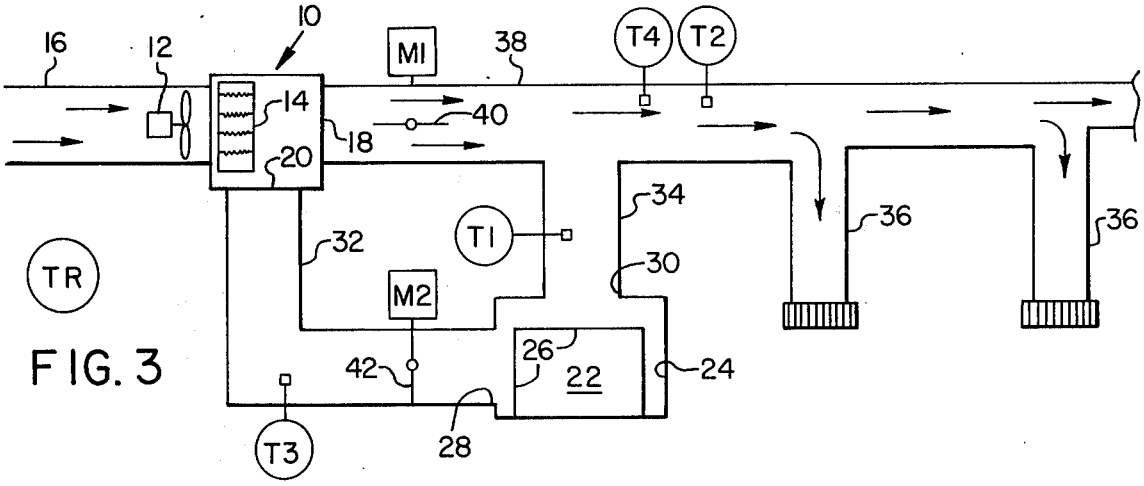
FIG. 3 is a schematic drawing of the system of FIG. 1, shown operating in a mode wherein the fireplace is generating insufficient heat to be usable as the primary heating source, and wherein the forced air furnace heating elements are instead being utilized as the heating source.

With reference to FIGS. 1, 2 and 3, the forced air heating system includes a conventional forced air furnace indicated generally as 10 having a motorized fan 12 and having a heating element or elements 14, which may be electrical resistance elements (as shown) or alternatively oil, gas or other fuel burners. The furnace receives ambient room air through a cold air return duct 16 and exhausts the air through any convenient exhaust assembly, which may comprise a single exhaust port or preferably a pair of exhaust ports such as 18 and 20.

The home or other building to be heated includes one or more fireplaces such as 22, the fireplace enclosure being surrounded by an air heating chamber 24 which receives heat from the fireplace through the walls 26 of the fireplace enclosure. The fireplace air heating chamber 24 has an inlet port 28 and an exhaust port 30 for circulating air through the chamber 24 to receive heat from the fireplace 22. The inlet port 28 of the fireplace heating chamber 24 is preferably connected to the exhaust assembly of the furnace 10, such as at the furnace exhaust port 20. This enables the furnace fan 12 to provide the air circulation through the fireplace heating chamber 24 and also enables the furnace heating element 14 to be utilized in a superheat mode if needed as will be explained hereafter. The inlet port 28 of the heating chamber may alternatively receive air from elsewhere if the foregoing advantages are not desired. A duct 32 connects the furnace exhaust port 20 with the heating chamber inlet port 28. The exhaust port 30 of the air heating chamber 24 is connected by another duct 34 to the air outlet registers such as 36 which deliver heated air to the rooms of the building, thereby enabling the fireplace heating chamber 24 to deliver heating air to the rooms without intermediate passage of the heated air through the furnace 10.

Also connected to the exhaust assembly of the furnace 10, such as at exhaust port 18, is a bypass duct 38 interconnecting the furnace exhaust assembly with the air outlet registers 36 independently of and in parallel with the fireplace heating chamber 24 and duct 34. The parallel bypass duct 38 enables air heated by the furnace 10 to be conducted directly to the air outlet registers 36 when desired without intermediate passage through the fireplace air heating chamber 24.

A pair of movable dampers 40 and 42 controlled by separate damper motors M1 and M2 respectively are provided in the two parallel duct systems, damper 40 controlling the flow of air from the furnace 10 directly to the air outlet registers 36, and the damper 42 controlling the flow of air through the fireplace air heating chamber 24 to the air outlet registers 36. The dampers 40 and 42 are movable to first positions as shown in FIG. 1 permitting the conduction of circulated air through the fireplace heating chamber 24 to the room outlet registers while preventing the conduction of air from the furnace directly to the air outlet registers through the bypass duct 38 or, alternatively, to second positions as shown in FIG. 3 permitting the conduction of circulated air through the bypass duct 38 while preventing the conduction of air through the fireplace heating chamber 24. The dampers are also movable to an intermediate position as shown in FIG. 2, which is similar to that shown in FIG. 1 except that the damper 40 only partially impedes the flow of air from the furnace exhaust port 18 to the air outlet registers 36 so as to mix air from the furnace 10 with air from the fireplace heating chamber 24 at a location intermediate the heating chamber and the air outlet registers under circumstances to be explained more fully hereafter. In order to accomplish the partial impedance of circulating air through the duct 38, the damper 40 may if desired be of a type more suitable for variable modulation of air flow, such as one having multiple hinged vanes.

Figure 4:
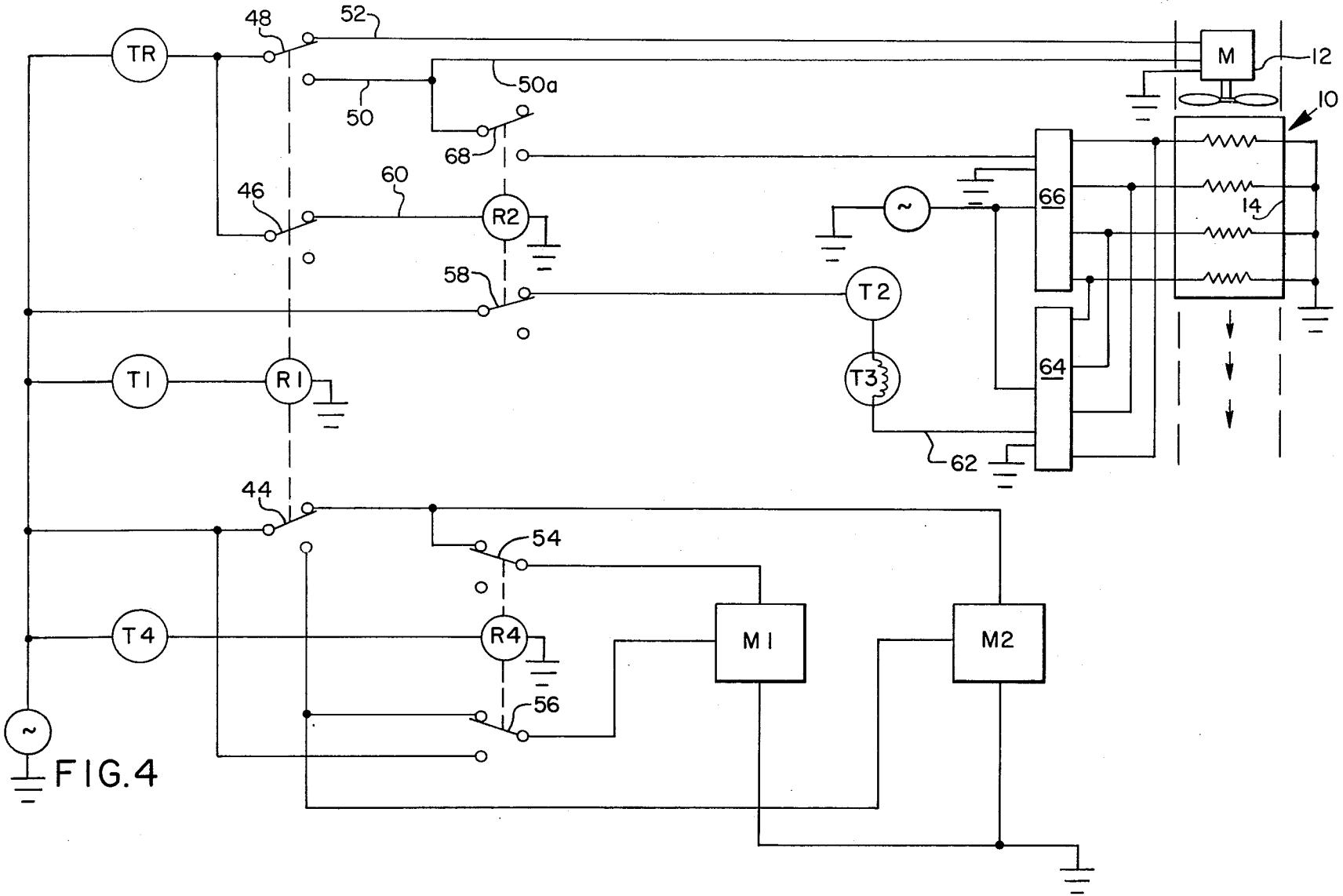
FIG. 4 is a simplified electrical schematic diagram of an exemplary temperature-sensitive control circuit adapted for use with the forced air heating system of the present invention.

With reference to FIG. 4, as well as the other figures, the exemplary temperature sensitive control circuit of the system comprises a conventional room thermostat TR positioned in the normal room location for sensing heating demand, multiple temperature sensors T1, T2 and T4 positioned either within the fireplace heating chamber 24 or downstream therefrom so as to be capable of sensing the temperature to which air is heated by the fireplace air heating chamber 24, and a temperature sensor T3 located either within the furnace 10 or between the furnace and the fireplace heating chamber 24 for sensing the temperature to which air is heated by the furnace heating element 14 in the superheat mode to be explained hereafter. The functions of these various components and their interrelationship to one another in the exemplary control circuit of FIG. 4 can be best understood by the following description of the operation of the system as a whole.

The operation of the system in the primary mode wherein the fireplace is generating a sufficient level of heat energy to serve as the primary heating source will be described first. A fire is started in the fireplace 22 and the air within the air heating chamber 24 and duct 34 thus begins to increase in temperature. The temperature sensor T1 senses the rise in temperature and, at a predetermined temperature, preferably about 140° F., the temperature sensor T1 energizes a relay R1 which simultaneously moves three switches 44, 46 and 48 to the positions shown in FIG. 4. (Although relays and switches are depicted in FIG. 4, the control circuit may utilize functionally equivalent switch circuitry of another type, such as solid state.) The movement of switch 44 to the position shown closes a power circuit to reversible damper motors M1 and M2, causing them to move the dampers 40 and 42 to their respective positions shown in FIG. 1 wherein air circulation through the duct 32, fireplace heating chamber 24 and duct 34 is permitted while circulation through duct 38 is prevented. The simultaneous movement of switch 48 to the position shown in FIG. 4 breaks the normal connection through line 50 whereby the room thermostat normally selectively activates or deactivates the furnace heating element 14 in response to ambient room temperature. The switch 48 does, however, continue the control of the activation or deactivation of the fan 12 through line 52 by the room thermostat TR. Thus the furnace fan 12 will continue to be operated in its normal manner, i.e. being activated when the room temperature falls below the thermostat setting and being deactivated when the room thermostat senses no demand for heat, thereby interrupting all air circulation both through the furnace and through the fireplace heating chamber 24. Accordingly the system, operating in the primary mode utilizing the fireplace 22 as the primary heat source, supplies heat to the air outlet registers 36 in response to demand as sensed by the room thermostat TR pursuant to the thermostat's control of the fan 12, which in turn regulates air circulation. This maintains the room temperature at a comfortable level during periods of high fireplace heat output.

In addition, if the heat output of the fireplace should be excessively high so that the temperature to which the circulating air is heated by the fireplace heating chamber 24 is above a predetermined temperature, this fact is sensed by temperature sensor T4 which responds by energizing relay R4, which in turn moves switches 54 and 56 to positions opposite to those shown in FIG. 4, thereby reversing damper motor M1 partially without also moving damper motor M2. Partial reversal of damper motor M1 causes the damper 40 to assume a position such as that indicated generally in FIG. 2, whereby air at ambient room temperature is allowed to pass through the furnace 10 and through the duct 38 to be mixed with air heated by the fireplace emerging from the duct 34. In this mode the air passing through duct 38 is at ambient temperature because the furnace heating element 14 has been prevented from activating as previously described. The mixture of the two airstreams takes place at the juncture of the ducts 38 and 34, at a location between the fireplace heating chamber 24 and the air outlet registers 36, and has the effect of reducing the temperature of the air delivered to the air outlet registers 36. The reduction of the air temperature to below the setting of sensor T4 in turn causes the sensor T4 to deenergize relay R4, moving switches 54 and 56 to the positions as shown in FIG. 4, which then causes damper motor M1 to return damper 40 to the position indicated in FIG. 1. While the feature just described with respect to the modulation of damper 40 to provide the cooling mixture of air is advantageous for the reasons described, it will be understood that such feature is an optional one and that the system is completely operable without such feature.

If, on the other hand, the temperature to which the circulating air is heated by the fireplace heating chamber 24 should drop below a predetermined temperature, which is preferably slightly lower than that temperature which was necessary to cause temperature sensor T1 to energize relay R1 in the first instance, this fact is sensed by temperature sensor T2. Temperature sensor T2 is capable, under certain circumstances, of activating the furnace heating element 14 when the temperature to which the fireplace heating chamber 24 heats the circulating air drops below the predetermined temperature setting of sensor T2. These circumstances occur when temperature sensor T2 receives electric current through the closure of switch 58 as shown in FIG. 4. As a prerequisite to the closure of switch 58, relay R2 must be energized through line 60. Line 60 in turn is energized only when switch 46 is closed (by the energization of relay R1 by temperature sensor T1) and furthermore only when the room thermostat TR senses a demand for heat. (It is also noteworthy that the energization of relay R2 when the room thermostat TR senses a demand for heat breaks switch 68, thereby preventing any possible activation of the heating element 14 in response to the fan control circuit 52 and 50*a*.) Accordingly, if all of the foregoing prerequisites are satisfied, the sensing by temperature sensor T2 of a circulating air temperature below a predetermined temperature causes temperature sensor T2 to activate furnace heating element 14 through line 62 and an appropriate conventional furnace heating element controller 64. Since the air inlet port 28 of the fireplace heating chamber 24 receives circulating air from the furnace exhaust assembly, specifically exhaust port 20, this activation of the furnace heating element 14 permits the furnace 10 to superheat the air which flows into the fireplace heating chamber, thereby permitting the fireplace 22, even when operating at a somewhat reduced heat generating level, to continue to be used as the primary heat source for the heating system.

Only a further reduction of the temperature of the air emitted from the fireplace heating chamber 24 will cause temperature sensor T1 to reverse the positions of the dampers 40 and 42 to the secondary mode positions shown in FIG. 3 and thereby cut off air circulation through the fireplace heating chamber 24 and return actuating control of the furnace heating element 14 to the room thermostat TR. For example the temperature sensor T2 may be set to actuate the furnace heating element 14 in the superheat mode if the temperature of the circulating air drops to 135° F., but the temperature sensor T1 will not deenergize relay R1 and thereby deactivate the fireplace heating chamber until the circulating air temperature falls to, say, 128° F, even though a higher air temperature of 140° F. was required to activate the fireplace heating chamber in the first instance. Thus, until the circulating air temperature as sensed by temperature sensor T1 falls below such lower predetermined setting, the fireplace continues to serve as the primary or constant heat source for the system, while the furnace heating element 14 is either completely deactivated or, alternatively, sequentially activated and deactivated in the superheat mode in response to temperature sensor T2.

Moreover in the superheat variation of the primary mode of operation, if the furnace 10 is of the type having a heating element 14 capable of variable modulated heat output, it is desirable to provide a further temperature sensor T3 responsive to the temperature to which the circulated air is heated by the furnace heating element for varying the rate of supplemental heat output from the furnace element so as to minimize the energy utilization to that which is just barely necessary. For example, temperature sensor T3 could be a thermistor whose resistance increases with temperature and therefore presents different voltages in line 62 depending upon the temperature sensed. If the furance heating element 14 comprises a plurality of resistance elements as shown in the figures, controller 64 can be a conventional voltage-responsive circuit for operating the various resistance elements in sequence as, for example, shown in U.S. Pat. No. 3,952,182. Alternatively, if the heating element 14 is an oil or gas burner, temperature sensor T3 could control the modulation of a temperature sensitive, variable fuel valve which controls the rate of fuel flow to the burner. It is considered preferable, if such a variable energy controller is provided for the operation of the furnace heating element in the superheat mode, to cause the furnace heating element to deliver only enough heating energy to provide an air temperature in duct 32 of about 100° F., it being expected that the fireplace heating chamber 24 will further increase the temperature of the air to at least that required by temperature sensor T1 to maintain the system in the primary mode of operation.

It should be recognized that the entire superheat variation of the primary mode of operation is desirable for maximum energy saving, but not absolutely necessary to the successful operation of a system of this type. A simpler system having no superheat mode of operation and simply having a temperature sensor T1 for switching the system between primary and secondary modes of operation would still achieve the majority of the energy saving objectives.

If, despite the assistance received by the superheat function of the furnace 10, the temperature of the circulating air as sensed by temperature sensor T1 drops below the lower predetermined temperature, the sensor T1 deenergizes the relay R1 which moves the switches 44, 46 and 48 to opposite positions from those shown in FIG. 4, thereby reversing the dampers 40 and 42 to the positions shown in FIG. 3, interrupting any energization of relay R2 and thereby breaking switch 58 and preventing control of the furnace heating element by temperature sensor T2, and concurrently restoring full control through line 50, switch 68 and conventional furnace controller 66 of the furnace heating element 14 by the room thermostat TR. Meanwhile the control of the fan 12 by the room thermostat TR is continued through line 50*a*. In the resultant secondary mode of operation as shown in FIG. 3, the furnace 10 is permitted to operate in the conventional manner feeding air through duct 38 directly to the air outlet registers 36 without intermediate passage through the ducts 32 or 34 or the fireplace heating chamber 24, activation of both the fan 12 and furnace heating element 14 being responsive to demand as sensed by the room thermostat TR in the conventional manner.

It will be apparent to those skilled in the art that the foregoing system can be used with such conventional room thermostats as those having multiple stages and night set backs, and also that structurally different but equivalent systems are possible. All such equivalent systems are intended to fall within the scope of the invention. Accordingly, the terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A forced air heating system for heating the rooms of a building comprising:

a. motorized fan means for circulating air;

b. a forced air furnace connected to said fan means having heating means for selectively heating air circulated through said furnace by said fan means and furnace exhaust means for exhausting said circulated air from said furnace;

c. a fireplace;

d. air heating chamber means adjacent said fireplace and connected to said fan means for receiving heat from said fireplace and thereby heating air circulated through said chamber means, said chamber means having means defining a chamber exhaust port for exhausting said circulated air from said chamber means;

e. air outlet register means for delivering heated air to the rooms of said building; and f. a pair of separate parallel duct means connecting said air outlet register means to each of said chamber exhaust port and furnace exhaust means respectively for conducting circulating air to said air outlet register means from either one of said chamber means and furnace without intermediate passage of said air through the other.

2. The heating system of claim 1, further including movable damper means associated with said pair of parallel duct means for selective movement either to a first position permitting the conduction of circulated air through a first one of said duct means connecting said chamber exhaust port to said air outlet register means while impeding the conduction of circulated air through the second one of said duct means connecting said furnace exhaust means to said air outlet register means or, alternatively, to a second position permitting the conduction of said circulated air through said second duct means while impeding the conduction thereof through said first duct means.

3. The heating system of claim 2 including temperature sensing means for sensing the temperature to which said circulated air is heated by said air heating chamber means, and damper actuating means connected to said damper means and automatically responsive to said temperature sensing means for placing said damper means in said first position when said temperature is above a predetermined temperature and for placing said damper means in said second position when said temperature is below a predetermined temperature.

4. The heating system of claim 3, further including a room thermostat for sensing ambient room temperature in said rooms and selectively activating or deactivating said heating means of said forced air furnace in response to said room temperature, and means responsive to said temperature sensing means for preventing the activation of said heating means of said furnace by said room thermostat independently of said room temperature when said temperature to which said circulated air is heated by said air heating chamber means is above a predetermined temperature.

5. A forced air heating system for heating the rooms of a building comprising:

a. a forced air furnace having heating means for selectively heating air circulated through said furnace and furnace exhaust means for exhausting said circulated air from said furnace;

b. a fireplace;

c. air heating chamber means adjacent said fireplace for receiving heat from said fireplace and thereby heating air circulated through said chamber means, said chamber means having means defining a chamber inlet port and a chamber exhaust port formed therein for circulating air through said chamber means;

d. air outlet register means for delivering heated air to the rooms of said building;

e. duct means connecting said furnace exhaust means and chamber exhaust port respectively with said air outlet register means for conducting air heated by said furnace and air heating chamber means respectively to said air outlet register means;

f. a room thermostat for sensing ambient room temperature in said rooms and selectively activating or deactivating said heating means of said forced air furnace in response to said room temperature;

g. temperature sensing means for sensing the temperature to which air is heated by said air heating chamber means; and h. means responsive to said temperature sensing means for preventing the activation of said heating means of said furnace by said room thermostat independently of said room temperature when said temperature to which said air is heated by said air heating chamber means is above a predetermined temperature.

6. The heating system of claim 5 wherein said duct means include means for connecting said furnace exhaust means with said inlet port of said air heating chamber means when said temperature to which said air is heated by said chamber means, as sensed by said temperature sensing means, is above said predetermined temperature, further including a second temperature sensing means for sensing the temperature to which said air is heated by said chamber means and means responsive to said second temperature sensing means for activating said heating means of said furnace during said prevention of activation of said heating means by said room thermostat when said temperature sensed by said second temperature sensing means is below a predetermined temperature.

7. The heating system of claim 6, further including means responsive to the temperature to which said circulated air is heated by said furnace heating means for varying the rate of heating energy generated by said heating means when said heating means is activated in response to said second temperature sensing means.

8. The heating system of claim 5, further including means responsive to said temperature sensing means for mixing air at substantially ambient room temperature with air conducted from said chamber means toward said air outlet register means when said temperature sensed by said temperature sensing means is above a predetermined temperature.

9. A forced air heating system for heating the rooms of a building comprising:

a. a forced air furnace having heating means for selectively heating air circulated through said furnace and furnace exhaust means for exhausting said circulated air from said furnace;

b. a fireplace;

c. air heating chamber means adjacent said fireplace for receiving heat from said fireplace and thereby heating air within said chamber means, said chamber means having means defining a chamber inlet port and a chamber exhaust port formed therein for circulating air through said chamber means;

d. first duct means connecting said furnace exhaust means with said chamber inlet port for selectively conducting said circulated air from said furnace to said chamber means to be heated by said fireplace;

e. air outlet register means for delivering heated air to the rooms of said building;

f. second duct means connecting said chamber exhaust port to said air outlet register means independently of said furnace for selectively conducting said circulated air from said chamber means to said air outlet register means without intermediate passage through said furnace; and g. bypass duct means interconnecting said furnace exhaust means with said air outlet register means independently of and in parallel with said chamber means for selectively conducting said circulated air from said furnace to said air outlet register means without intermediate passage through said chamber means.

10. The heating system of claim 9, further including movable damper means associated with said respective duct means for selective movement either to a first position permitting the conduction of said circulated air through said chamber means while impeding the conduction thereof through said bypass duct means or, alternatively, to a second position permitting the conduction of said circulated air through said bypass duct means while impeding the conduction thereof through said chamber means.

11. The heating system of claim 10 including temperature sensing means for sensing the temperature to which said circulated air is heated by said chamber means, and damper actuating means connected to said damper means and automatically responsive to said temperature sensing means for placing said damper means in said first position when said temperature is above a predetermined temperature, and for placing said damper means in said second position when said temperature is below a predetermined temperature.

12. The heating system of claim 11, further including a room thermostat for sensing ambient room temperature in said rooms and selectively activating or deactivating said heating means of said forced air furnace in response to said room temperature, and means responsive to said temperature sensing means for preventing the activation of said heating means of said furnace by said room thermostat independently of said room temperature when said temperature to which said circulated air is heated by said chamber means is above a predetermined temperature.

13. The heating system of claim 12, further including a second temperature sensing means for sensing the temperature to which said circulated air is heated by said chamber means, and means responsive to said second temperature sensing means for activating said heating means of said furnace during said prevention of activation of said heating means by said room thermostat when said temperature sensed by said second temperature sensing means is below a predetermined temperature.

* * * * *